US008985081B2

(12) United States Patent
Kim

(10) Patent No.: US 8,985,081 B2
(45) Date of Patent: Mar. 24, 2015

(54) ENGINE VALVE DEVICE

(75) Inventor: Yong Lae Kim, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 0 days.

(21) Appl. No.: 13/510,827

(22) PCT Filed: Nov. 19, 2010

(86) PCT No.: PCT/KR2010/008177

§ 371 (c)(1),
(2), (4) Date: Oct. 4, 2012

(87) PCT Pub. No.: WO2011/062434

PCT Pub. Date: May 26, 2011

(65) Prior Publication Data

US 2013/0014720 A1 Jan. 17, 2013

(30) Foreign Application Priority Data

Nov. 19, 2009 (KR) ..... 10-2009-0111780

(51) Int. Cl.
*F01L 3/02* (2006.01)
*F01L 3/08* (2006.01)
*F01L 3/00* (2006.01)

(52) U.S. Cl.
CPC ... *F01L 3/08* (2013.01); *F01L 3/00* (2013.01); *F01L 2810/02* (2013.01)
USPC ..... 123/188.3; 123/188.6

(58) Field of Classification Search
CPC ..... F01L 2810/02; F01L 3/08; F01L 201/00; F01L 2/04
USPC ..... 123/188.3, 188.6, 188.9, 188.2, 90.37, 123/90.11, 188.11, 90.33
See application file for complete search history.

(56) References Cited

U.S. PATENT DOCUMENTS

| | | | | |
|---|---|---|---|---|
| 3,265,052 | A * | 8/1966 | Goloff | 123/188.9 |
| 3,498,621 | A * | 3/1970 | Wilson | 277/502 |
| 3,885,546 | A * | 5/1975 | Foley et al. | 123/188.6 |
| 5,190,002 | A * | 3/1993 | Wietig | 123/188.3 |
| 5,465,691 | A | 11/1995 | Capaldo | |

(Continued)

FOREIGN PATENT DOCUMENTS

| | | |
|---|---|---|
| EP | 2112337 | 10/2009 |
| JP | 63-118314 | 7/1988 |

(Continued)

OTHER PUBLICATIONS

JP0709124A Machine Translation, see "JP0709124A_ MachineTranslation.pdf".*

(Continued)

*Primary Examiner* — Noah Kamen
*Assistant Examiner* — Long T Tran
(74) *Attorney, Agent, or Firm* — John D. Veldhuis-Kroeze; Westman, Champlin & Koehler, P.A.

(57) ABSTRACT

The present disclosure relates to an engine valve device including: engine valves; valve guides configured to guide a reciprocating motion of the engine valves; and stem seals fitting on one end of each of the valve guides and circumferentially covering the engine valves, in which the engine valves have micro-machined oil ports on the surfaces surrounded by the valve guides or the stem seals.

5 Claims, 5 Drawing Sheets

(56) References Cited

U.S. PATENT DOCUMENTS

| | | | | |
|---|---|---|---|---|
| 6,571,761 | B1 * | 6/2003 | Leimer | 123/188.6 |
| 6,571,819 | B1 * | 6/2003 | Capoferi | 137/315.41 |
| 6,764,079 | B1 | 7/2004 | Hegemier et al. | |
| 2004/0200451 | A1 | 10/2004 | Leimer | |
| 2005/0217764 | A1 * | 10/2005 | Takayama | 148/321 |
| 2009/0288619 | A1 * | 11/2009 | Koneda et al. | 123/90.11 |

FOREIGN PATENT DOCUMENTS

| | | | |
|---|---|---|---|
| JP | 07-091214 | | 4/1995 |
| JP | 07091214 | | 4/1995 |
| JP | 08296414 | | 11/1996 |
| JP | 10009400 | A * | 1/1998 |
| JP | 2005-180329 | | 7/2005 |

OTHER PUBLICATIONS

European Search Report dated Aug. 1, 2013, issued in European Application No. 10831801.5, 5 pages.

International Search Report for PCT Application No. PCT/KR2010/008177, dated Jul. 14, 2011, 10 pages.

Office Action dated Dec. 4, 2013 issued in Chinese Patent Application No. 201080059456.5, 6 pages.

* cited by examiner

ENGINE VALVE DEVICE

This Application is a Section 371 National Stage Application of International Application No. PCT/KR2010/008177, filed Nov. 19, 2010 and published, not in English, as WO2011/062434 on May 26, 2011.

FIELD OF THE DISCLOSURE

The present disclosure relates to an engine valve device, and more particularly, to a guide structure that guides the surface of the intake and exhaust valves and a reciprocating motion of the valves in an internal combustion engine.

BACKGROUND OF THE DISCLOSURE

Valves are parts opening/closing the intake port and the exhaust port of the combustion chamber in an engine, in which an intake valve allows air for combustion to flow into the combustion chamber and an exhaust valve allows the gas burned by compression and explosion in the combustion chamber to be discharged outside.

The engine valves repeat high-speed operation, similar to the driving system such as a piston or a crankshaft, and the intake valve and the exhaust valve make one reciprocating motion for every two revolutions of the engine when the engine operates at 2000 rpm in a four-stroke internal combustion engine and make one hundred reciprocating motions per minutes, which causes a very severe operating condition.

Valves mainly make a vertical straight motion and also make a rotating motion about a vertical axis and a valve guide is the part that functions as a guide making the motions smooth.

Referring to FIG. 1, a valve guide 200 is usually formed in a cylindrical shape fixed to an engine block 10, has engine valves 100 therein to guide the vertical reciprocating motion of the engine valves 100, and is made of a relatively soft material in comparison to the engine valves 100 such that the valves are not worn out.

Wear is generated by friction due to a reciprocating motion between the engine valve 100 and the valve guide 200 and the amount of wear of the valve guide 200 is large, such that the gap between the engine valve 100 and the valve guide 200 increases, which may cause noise in the reciprocating motion of the engine valve and malfunction of the valve.

Further, a lubrication film is formed between the engine valve 100 and the valve guide 200 by injecting a lubricant in order to reduce the amount of wear of the valve guide 200, but it is preferable to keep the gap between the engine valve and the valve guide narrow within a range where the valve can reciprocate such that the lubricant does not flow into the engine combustion chamber 20 along the valve.

That is, when the amount of lubrication is too large, the lubricant oil flowing into the engine combustion chamber 20 increases, such that the amount of noxious exhaust gas due to combustion of the oil increases and the amount of consumed lubricant increases, whereas when the amount of lubrication is small, the friction between the valve and the valve guide increases.

Referring FIGS. 1 and 2, a circular stem seal 300 is fitted between the engine valve 100 and the valve guide 200 to stably guide the reciprocating motion of the engine valve 100 and to prevent the lubricant from excessively flowing to the engine valve 100.

The stem seal 300 is a seal fitting on one end of the valve guide 200 and surrounding the cylindrical main body portion of the engine valve 100, and generally has a ring shape.

The material of the stem seal 300 is usually an elastic material with predetermined elasticity such as rubber, surrounds the engine valve 100, and scrapes the lubricant off the surface of the engine valve 100 while guiding the reciprocating motion of the engine valve 100, such that it can prevent the lubricant from flowing into the engine combustion chamber.

The stem seal 300 is generally fixed to the upper end of the valve guide 200 by a stem seal case 330 and circumferentially surrounding the main column portion of the engine valve by a stem seal fixing spring 320 in close contact with the engine valve 100.

Further, the stem seal 300 has a contact portion called a stem seal rib 310 directly scraping the lubricant while guiding a reciprocating motion in close contact with the column portion of the engine valve 100 and is divided, in accordance with the number of formed stem seal ribs 310, into a single rib type with one rib, as illustrated in FIG. 2 (*a*), and a multi-rib type with two or more ribs, as shown in FIG. 2 (*b*).

The multi-rib type of stem seal is complicated in structure and expensive in comparison to the single rib type of stem seal, but a plurality of ribs, the contact portions, are formed, such that the function of removing a lubricant film and the pressing force for guiding the reciprocating motion of the valve are excellent.

When the gap between the engine valve and the valve guide increases, the lubricant film also increases, such that the amount of lubricant to be scraped increases, and it is necessary to use an expensive multi-rib type of stem seal in order to prevent the engine valve from slightly inclining in the valve guide.

As a result, since it is difficult for the valve to stably operate and it is necessary to use an expensive stem seal in order to remove an excessive lubricant, when the gap between the engine valve and the valve guide is increased by wear, it is required to keep effective lubrication conditions between the engine valve and the valve guide in order to reduce wear.

The discussion above is merely provided for general background information and is not intended to be used as an aid in determining the scope of the claimed subject matter.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present disclosure is contrived to solve the above-mentioned problems, and the object of the present disclosure is to provide an engine valve device configured to ensure stable operation of an engine valve in an engine, generates less wear of parts and consumes less lubricant when operating, and is manufactured at low cost.

In order to achieve the above object, the present disclosure provides an engine valve device including: engine valves 100; valve guides 200 configured to guide a reciprocating motion of the engine valves 100; and stem seals 300 fitting on one end of each of the valve guides 200 and circumferentially covering the engine valves 100, in which the engine valves 100 have micro-machined oil ports 110 on the surfaces surrounded by the valve guides 200 or the stem seals 300.

Further, the stem seal 300 may have one stem seal rib 310 protruding toward the engine valve 100 and circumferentially covering the engine valve 100 in contact with the engine valve 100.

Further, the oil ports 110 may be formed by laser machining and the shape of the oil ports 110 may be any one selected from a semicircle, an ellipse, and a rectangle.

According to an exemplary embodiment of the present disclosure, since a lubricant remains in the micro-machined oil ports and an appropriate lubricant film is formed between the engine valve and the valve guide, it is possible to reduce wear due to friction between the engine valve and the valve guide in addition to allowing the engine valve to stably operate.

Further, since it is possible to keep the gap between the engine valve and the valve guide narrow and the lubricant flowing into the combustion chamber through between the valve and the valve guide correspondingly reduces, it is possible to reduce a noxious exhaust gas due to combustion of the lubricant and also reduce the amount of consumed lubricant.

Further, since it is possible to guide the motion of the engine valve and remove the lubricant, even using an inexpensive single type of stem seal, it is possible to reduce the manufacturing cost.

| | |
|---|---|
| 10: Engine block | 20: Engine combustion chamber |
| 100: Engien valve | 110: Oil port |
| 200: Valve guide | 300: Stem seal |
| 310: Stem seal rib | 320: Stem seal fixing spring |
| 330: Stem seal case | |

DETAILED DESCRIPTION

Advantages and features of the present disclosure and methods for achieving them will be made clear from exemplary embodiments described below in detail with reference to the accompanying drawings. An engine valve device according to an exemplary embodiment of the present disclosure will be described with reference to the accompanying drawings.

Figure 1:
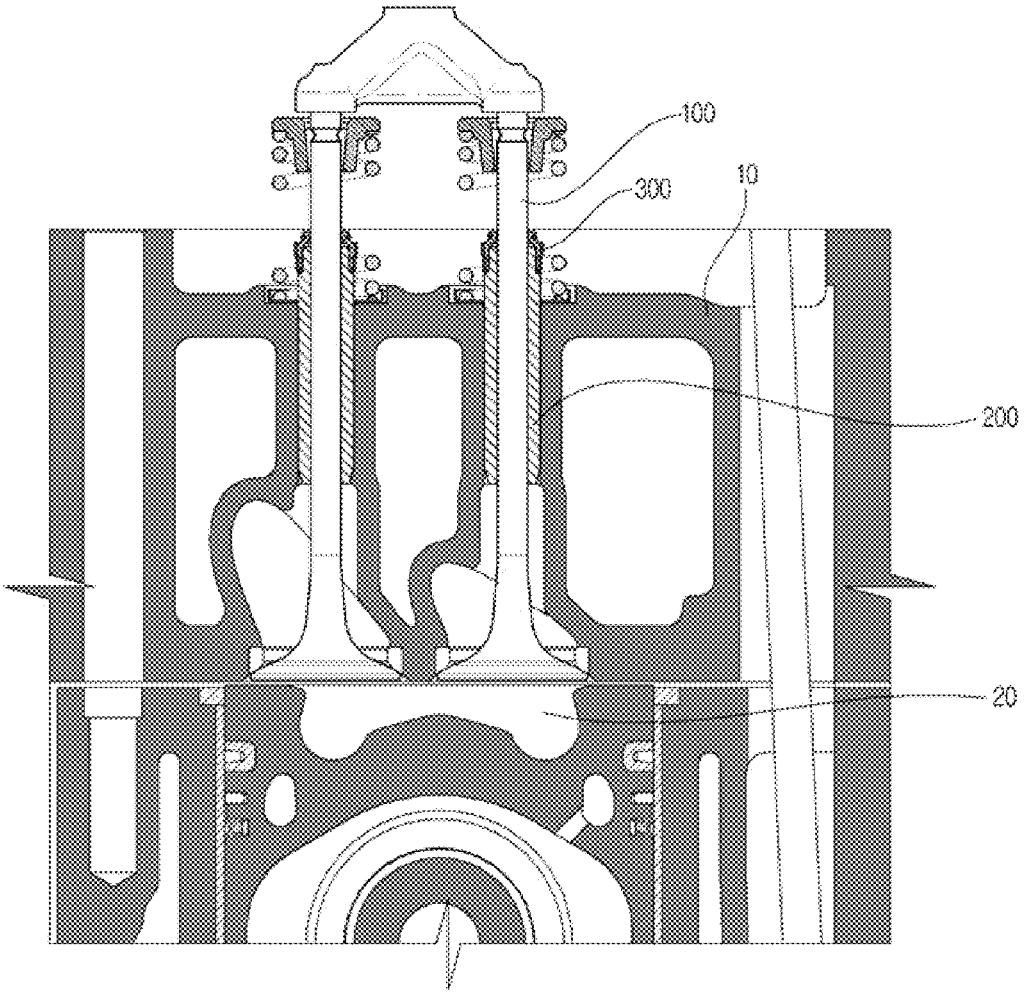
FIG. 1 is a cross-sectional view illustrating the combination structure of an engine valve and a valve guide in an engine.
Figure 2:
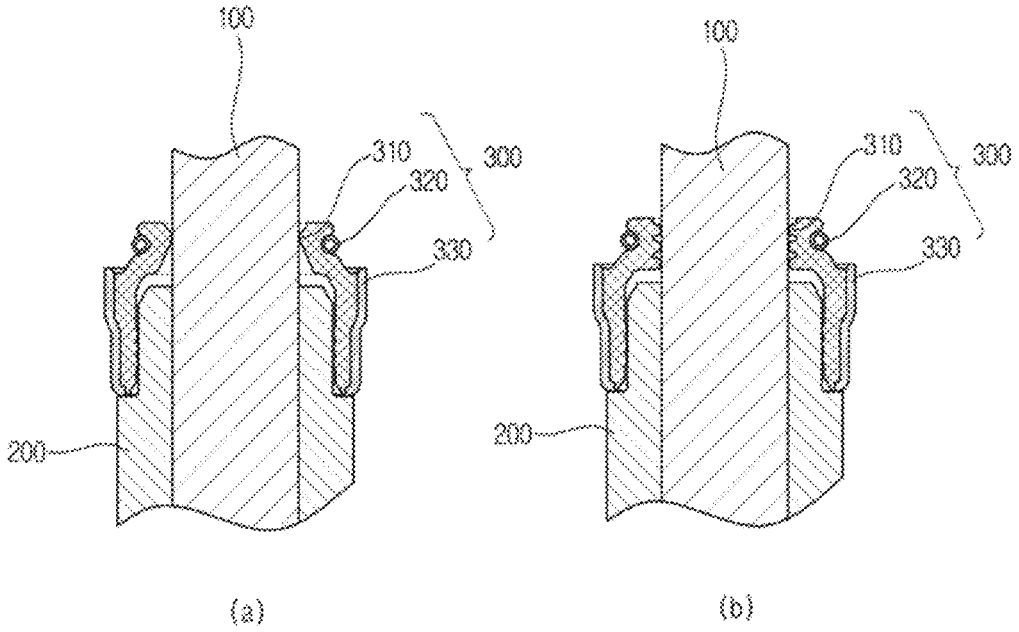
FIG. 2 is a cross-sectional view schematically illustrating the shape and structure of a stem seal.

Referring to FIG. 1, an engine valve device according to an exemplary embodiment of the present disclosure includes engine valves 100, valve guides 200 guiding a reciprocating motion of the engine valves 100, and stem seals 300 fitting on one end of the valve guides 200 and circumferentially covering the engine valves.

The valve guide 200 is fixed to an engine block 10 and the cylindrical portion that is the main body of the engine valve 100 is disposed in the cylindrical valve guide 200, such that the engine valve 100 reciprocates up and down in contact with the inner side of the valve guide 200.

Figure 3:
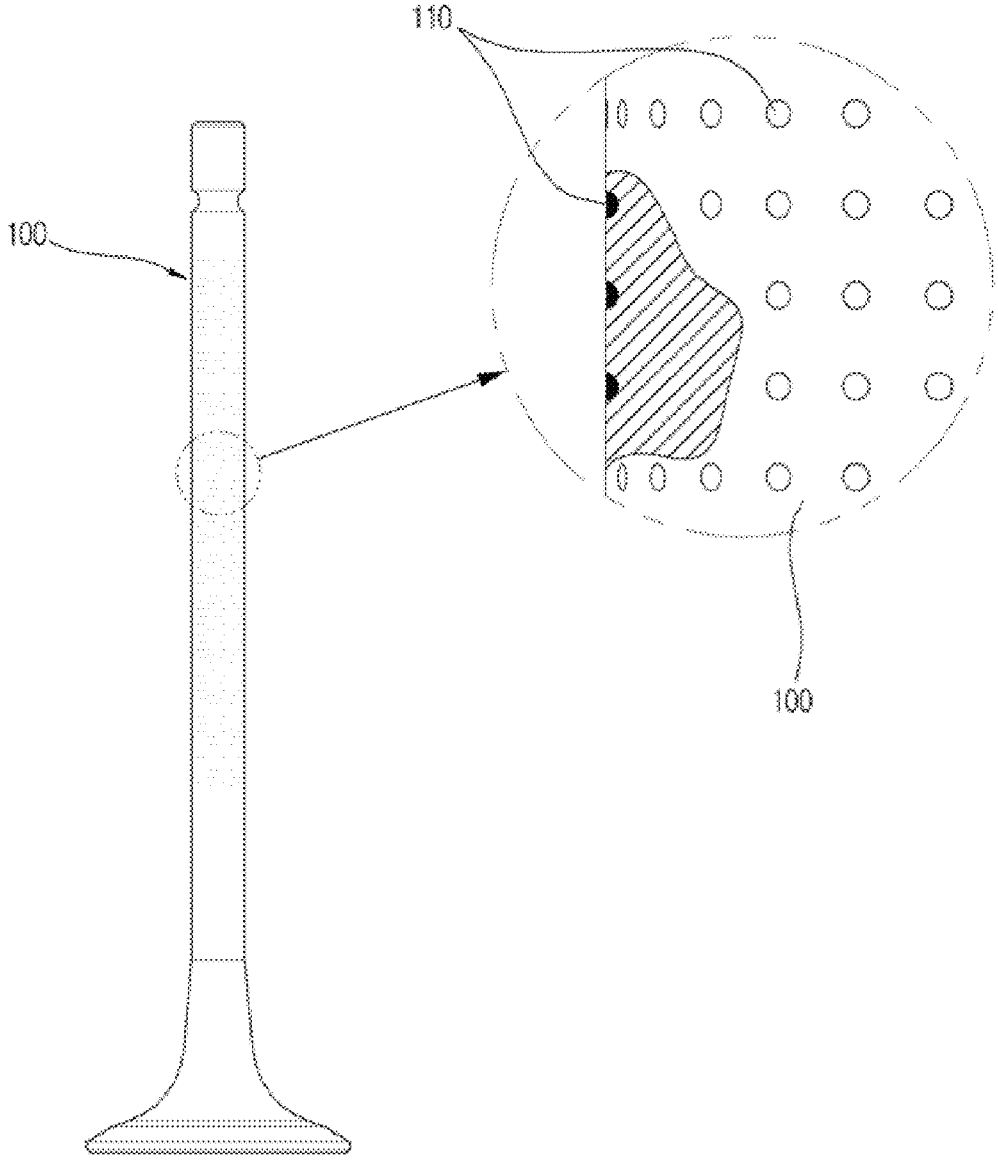
FIG. 3 is a perspective view schematically illustrating when laser texturing has been applied to an engine valve in an engine according to an exemplary embodiment of the present disclosure.

Referring to FIG. 3, the engine valve 100 has micro-machined oil ports 110 on the surface surrounded by the valve guide 200 or the stem seal 300, and micro-holes or dimples may be formed on the surface by micro-machining the column portion of the engine valve 100.

The micro-machining may be performed by surface treatment forming a predetermined pattern on a surface, using a laser beam, which is called laser texturing or surface texturing, thus micro-holes called oil ports 110 or dimples are formed on the surface of a material.

As illustrated in the enlarge picture of FIG. 3, when a lubricant is supplied to the laser-textured surface of the engine valve 100 and a lubricant film is formed, the oil ports 110 hold and store the lubricant and supply the lubricant to the surface of the engine valve, thereby improving a lubricating effect.

In general, the oil port 110 is, as illustrated in the figure, formed in a circle and the cross-section has s semicircular dimple shape, and though not illustrated in the figure, may be machined in various shapes such as a rectangle or an ellipse in accordance with the shape of the friction surface or the friction direction, and the gaps between the oil ports 110 may be set in various ways.

Although it is preferable to set the area of laser texturing that are performed on the engine valve 100 to cover the entire portion that comes in contact with the valve guide 200 while the engine valve 100 reciprocates, the laser texturing may be partially applied within a range of improving the lubrication performance, because relatively high cost is required for the laser texturing.

That is, laser texturing may be limited to the portion where wear is experimentally concentrated and it may be possible to achieve an effect close to performing laser texturing on the entire friction surface while reducing the machining cost, by limiting the laser texturing to both end portions of the reciprocating motion of the engine valve 100.

Figure 4:
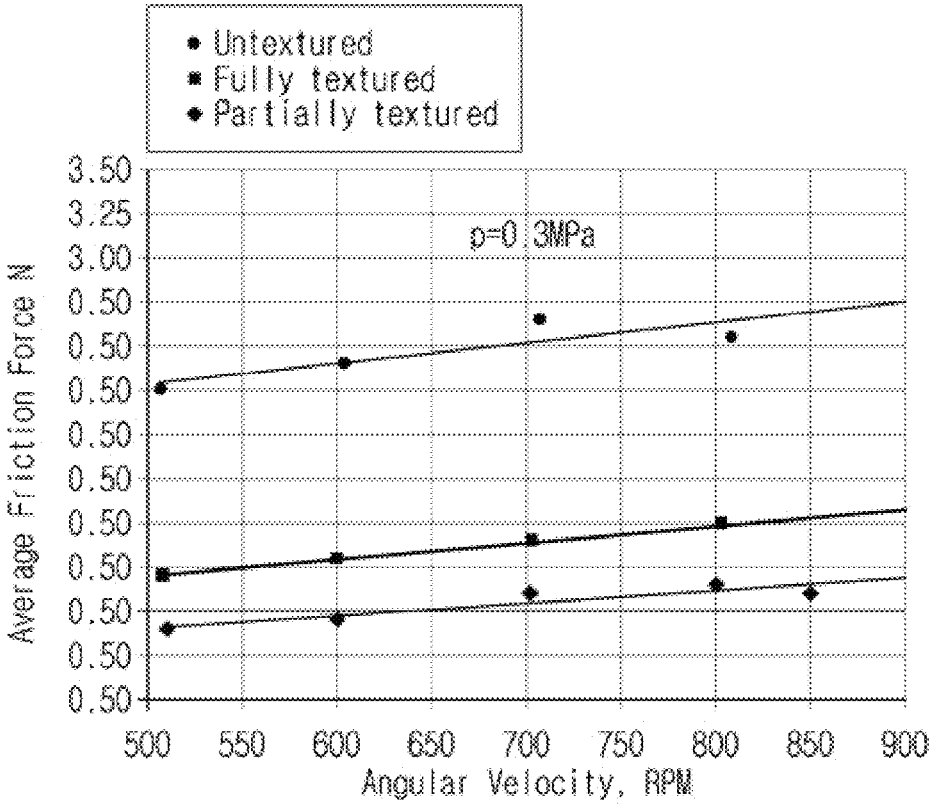
FIG. 4 is a graph illustrating a test result of lubrication performance of a laser-textured engine valve in an engine valve device according to an exemplary embodiment of the present disclosure.

FIG. 4 illustrates a text result in which friction force reduced by half in an engine valve where laser texturing has been fully or partially performed, as compared with an engine valve where laser texturing has not been performed, under the same lubrication conditions.

As illustrated in the graph of FIG. 4, comparing an engine valve with the entire friction portion laser-textured and an engine valve with partial laser texturing, although there is a small difference, it is possible to reduce the manufacturing cost and the manufacturing time by performing texturing within an appropriate range by comparing the manufacturing costs and the effects.

Referring to FIGS. 2 to 5, the stem seal 300 is a seal fitting on the valve guide 200 and covering the cylindrical main body of the engine valve 100, and generally has a ring shape.

As described above, the stem seal 300 has a stem seal rib 310 protruding toward the engine valve 100 and circumferentially covering the engine valve 100 in contact with the engine valve 100, and falls into a single rib type and a multi-rib type in accordance with the number of stem seal ribs 310.

When laser texturing is applied to the contact portion between the engine valve 100 and the valve guide 200, lubrication is smoothly performed, with the gap between the engine valve 100 and the valve guide 200 kept narrow; therefore, the reciprocating motion of the engine valve 100 can be more stably guided by the valve guide 200 and the amount of lubricant to be scraped correspondingly reduces.

Therefore, the stem seal 300 is enough to scrape the lubricant while guiding the reciprocating motion of the engine valve 100, even though the stem seal 300 is a single rib type of stem seal 300 with one stem seal rib 310 being in contact with the engine valve 100.

Accordingly, it is possible to achieve an effect of considerably reducing the manufacturing cost in comparison to necessarily using an expensive multi-rib type of stem seal as a precaution against an increase in gap between an engine valve and a valve guide due to wear in the related art.

Figure 5:
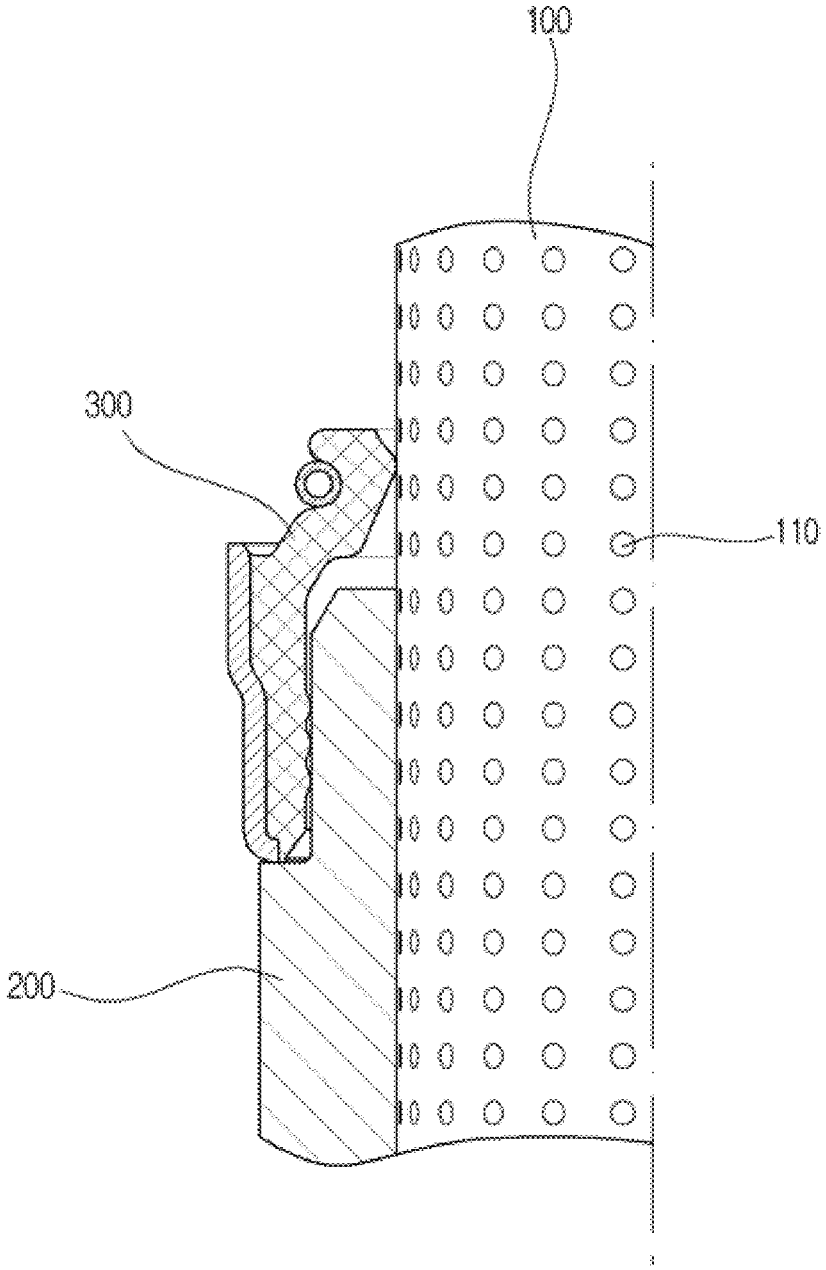
FIG. 5 is a cross-sectional view illustrating the combination structure of the engine valve device according to an exemplary embodiment of the present disclosure.

FIG. 5 shows the structure when the engine valve 100 with the micro-machined oil ports 110 fits in the single rib type of stem seal 300 and the valve guide 200, in which it is possible to achieve a smooth lubrication effect even without using a multi-rib type of stem seal.

Although exemplary embodiments of the present disclosure have been described above with reference to the drawings, it will be understood to those skilled in the art that the present disclosure may be implemented in various ways without changing the spirit of necessary features of the present disclosure.

Therefore, the exemplary embodiments described above should be construed as being exemplified and not limiting the present disclosure, the scope of the disclosure is characterized by the detailed description of the following claims, and all changes and modifications from the meaning, range, and equivalent concept of claims should be construed as being included in the present disclosure.

The present disclosure may be applied to the valve device in internal combustion engines.

Although the present disclosure has been described with reference to exemplary and preferred embodiments, workers skilled in the art will recognize that changes may be made in form and detail without departing from the spirit and scope of the disclosure.

The invention claimed is:

1. An engine valve device comprising:

engine valves each having a column portion;

valve guides surrounding the column portions of the engine valves and configured to guide a reciprocating motion of the engine valves; and stem seals fitting on one end each of the valve guides and circumferentially covering the engine valves, wherein the engine valves have micro-machined oil ports formed on surfaces of the column portions which are surrounded by the valve guides or the stem seals.

2. The device of claim 1, wherein the stem seals have one stem seal rib protruding toward the engine valve and circumferentially covering the engine valve in contact with the engine valve.

3. The device of claim 1, wherein the oil ports are formed by laser machining.

4. The device of claim 1, wherein the shape of the oil ports is any one selected from a semicircle, an ellipse, and a rectangle.

5. The device of claim 3, wherein the shape of the oil ports is any one selected from a semicircle, an ellipse, and a rectangle.

* * * * *